US006998946B2

(12) United States Patent
Feng et al.

(10) Patent No.: US 6,998,946 B2
(45) Date of Patent: Feb. 14, 2006

(54) HIGH CYCLE DEFLECTION BEAM MEMS DEVICES

(75) Inventors: Milton Feng, Champaign, IL (US); Richard Chan, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 49 days.

(21) Appl. No.: 10/245,790

(22) Filed: Sep. 17, 2002

(65) Prior Publication Data

US 2004/0050675 A1 Mar. 18, 2004

(51) Int. Cl.
*H01H 51/22* (2006.01)

(52) U.S. Cl. ..... 335/78; 200/181
(58) Field of Classification Search ..... 335/78–80; 200/181
See application file for complete search history.

(56) References Cited

U.S. PATENT DOCUMENTS

| | | | | |
|---|---|---|---|---|
| 4,959,515 A | | 9/1990 | Zavracky et al. | |
| 5,168,249 A | | 12/1992 | Larson | |
| 5,258,591 A | | 11/1993 | Buck | |
| 5,619,061 A | * | 4/1997 | Goldsmith et al. | 257/528 |
| 5,677,823 A | | 10/1997 | Smith | |
| 5,929,497 A | | 7/1999 | Chavan et al. | |
| 6,046,659 A | | 4/2000 | Loo et al. | |
| 6,091,050 A | | 7/2000 | Carr | |
| 6,100,477 A | | 8/2000 | Randall et al. | |
| 6,124,650 A | * | 9/2000 | Bishop et al. | 310/40 MM |
| 6,143,997 A | * | 11/2000 | Feng et al. | 200/181 |
| 6,307,452 B1 | * | 10/2001 | Sun | 333/262 |
| 6,472,962 B1 | * | 10/2002 | Guo et al. | 333/262 |
| 6,483,395 B1 | | 11/2002 | Kasai et al. | |

(Continued)

OTHER PUBLICATIONS

J.L. Ebel, A.P. Walker, R.E. Strawser, R. Cortez, K.D. Leedy, G.C. DeSalvo, "Investigation of MEMS RF switches for low loss phase shifters", GOMAC 2001 Digest of Papers, pp. 87–89, Mar. 2001.

C. Goldsmith, J. Ehmke, A. Malczewski, B. Pillans, S. Eshelman, Z. Yao, J. Brank, and M. Eberly, "Lifetime characterization of capacitative RF MEMS switches", IEEE MTT–S 2001 International Microwave Symposium Digest, pp. 227–230, May 2001.

U.S. Appl. No. 10/191,812, filed Jul. 9, 2002, Feng et al.

C.L. Goldsmith, Zhimin Yao, Susan Eshelman, and David Denniston, "Performance of Low–Loss RF MEMS Capacitive Switches" *IEEE Microwave and Guides Wave Letters*, vol. 8, No. 8, Aug. 1988, pp. 269–271.

(Continued)

*Primary Examiner*—Elvin G. Enad
*Assistant Examiner*—Bernard Rojas
(74) *Attorney, Agent, or Firm*—Greer, Burns & Crain, Ltd

(57) ABSTRACT

A high life cycle MEMS device is provided by the invention. The inventors have recognized that the deflection beam or deflection beams of an MEMS shunt switch are a failure point in need of improvement. In an aspect of the invention, at least a portion of the signals in the grounded state of an MEMS shunt switch are bypassed to ground on a path that avoids the deflection beam(s) supporting the movable pad. In a preferred embodiment, ground posts are disposed to contact the movable pad in an actuated position and establish a signal path from a signal line to ground. The inventors have also recognized that a shape of deflection beams near their anchor point contributes to failures. In another preferred aspect of the invention, an anchoring portion of the deflection beam or deflection beams is generally coplanar with the remaining portion of the deflection beam(s). An additional post beneath the anchoring portion of the deflection beam(s) permits deflection beam(s) lacking any turns that form a weak structural point.

17 Claims, 4 Drawing Sheets

U.S. PATENT DOCUMENTS

| | | | | | |
|---|---|---|---|---|---|
| 6,529,093 | B1 | | 3/2003 | Ma | |
| 6,657,525 | B1 | | 12/2003 | Dickens et al. | |
| 6,700,172 | B1 | * | 3/2004 | Ehmke et al. | 257/415 |
| 6,713,695 | B1 | * | 3/2004 | Kawai et al. | 200/181 |
| 6,812,814 | B1 | | 11/2004 | Ma et al. | |
| 2002/0171517 | A1 | * | 11/2002 | Guo et al. | 333/262 |

OTHER PUBLICATIONS

N. Scott Barker, Gabriel M. Rebeiz, "Distributed MEMS True–Time Delay Phase Shifters and Wide–Bank Switches", *IEEE Transactions on Microwave Theory and Techniques*, vol. 46, No. 11, Nov. 1988, pp. 1881–1890.

Elliot R. Brown, "RF–MEMS Switches for Reconfigurable Integrated Circuits", *IEEE Transactions on Microwave Theory and Techniques*, vol. 46, No. 11, Nov. 1998, pp. 1868–1880.

J. Jason Yao, M. Frank Chang, "A Surface Micromachined Miniature Switch for Telecommunications Applications with Signal Frequencies from DC up to 4 GHZ", IEEE conference paper, 1995.

Chuck Goldsmith, Tsen–Hwang Lin, Bill Powers, Wen–Rong Wu, Bill Norvell, "Micromechanical Membrane Switches for Microwave Applications", *IEEE MTT–S Digest*, 1995, pp. 91–94.

C. Goldsmith Z. Yao, S. Eshelman, D. Denniston, S. Chen, J. Ehmke, A. Malczewski, R. Richards, "Micromachining of RF Devices for EMicrowave Applications", Raytheon T1 Systems Materials.

J. Jason Yao, Sang Tae Park, and Jeffrey DeNatale, "High Tuning–Ratio MEMS–Based Tunable Capacitors for RF Communications Applications", Solid State Sensor and Actuator Workshop, Hilton Head Island, South Carolina, Jun. 8, 1998.

* cited by examiner

HIGH CYCLE DEFLECTION BEAM MEMS DEVICES

STATEMENT OF GOVERNMENT INTEREST

This invention was made with United States Government support under Contract Number F33615-99-C-1519 awarded by the Defense Advanced Research Project Agency (DARPA). The Government has certain rights in this invention.

FIELD OF THE INVENTION

The field of the invention is micro-electromechanical systems (MEMS).

BACKGROUND OF THE INVENTION

MEMS devices are macroscale devices including a pad that is movable in response to electrical signaling. The movable pad, such as a membrane or cantilevered conductive arm, moves in response to an electrical signal to cause an electrical or mechanical effect. A particularly useful MEMS device is the MEMS shunt switch. A MEMS shunt switch grounds a signal line in one state and permits signal flow in another state. A particular switch, the RF MEMS shunt switch is an RF (radio frequency) ohmic switch. In an RF MEMS shunt switch, application of an electrical signal causes a cantilevered conductive switch pad to ground or remove from ground state a signal line by completing or breaking ohmic contact with the signal line.

MEMS lifetimes continue to be shorter than would make their use widespread. Successes in the range of 1–3 billion "cold" switching cycles have been reported. High frequency applications are especially suited to MEMS devices, and can exceed reported switching cycles in ordinary usage. Also, there is typically a difference between "hot" and "cold" switching lifetimes. Hot switching, i.e., a switching test conducted with signals present, is a different measure of operational conditions that usually shows a shorter lifetime than cold switching tests would indicate. Both types of tests are used in the art. Comparisons between the same tests are valid. However, the hot switching tests are more representative of actual operating conditions.

A common cause of failure identified by the present inventors is the deformation and breakdown of the deflection beams used to support the movable pad. Spring force supplied by the deflection beams is necessary for the operation of the switch. The deflection beams are formed from thin material, having the thinness of the movable switch pad. A loss of resiliency or breakdown of the deflection beams causes a breakdown of the switch.

SUMMARY OF THE INVENTION

The inventors have recognized that the deflection beam or deflection beams of an MEMS shunt switch are a failure point in need of improvement. The inventors have specifically identified that the signal path to ground contributes to failure at the deflection beams and results in a hot switching time that is substantially shorter than the cold switching lifetime. The path of signals through the deflection beam(s) to ground weakens the deflection beam(s). According to the invention, at least a portion of the signals in the grounded state of an MEMS shunt switch are bypassed to ground on a path that avoids the deflection beam(s) supporting the movable pad. In a preferred embodiment of the invention, ground posts are disposed to contact the movable pad in an actuated position and establish a signal path from a signal line to ground. The inventors have also recognized that the shape of deflection beams near their anchor point contributes to failures. In another preferred embodiment of the invention, an anchoring portion of the deflection beam or deflection beams is generally coplanar with the remaining portion of the deflection beam(s). An anchor post beneath the anchoring portion of the deflection beam(s) permits deflection beam(s) lacking any out-of-plane turns that form a weak structural point.

DETAILED DESCRIPTION OF THE PREFERRED EMBODIMENTS

The invention is directed toward reducing the failure rate attributable to deflection beams of MEMS shunt switches, especially under "hot" switching conditions that more closely approximate real life operation. An aspect of the invention concerns the signal routing in an MEMS shunt switch. A ground signal path is established that avoids the deflection beam or deflection beams suspending the movable switch pad. In another aspect of the invention, a post supports the anchor point of a deflection beam or deflection beams in a MEMS switch to permit a generally flat coplanar deflection beam. The invention will now be illustrated with respect to the preferred embodiments but is not limited to the preferred embodiments. For example, while a preferred embodiment is a balanced RF MEMS shunt switch including multiple deflection beams, the invention is applicable to any type of shunt switch including one or more deflection beams. Embodiments of the invention may be formed in a Group III–V material system. In addition, a silicon based integration is possible. Use of silicon requires a deposition of a polymer upon the silicon substrate prior to formation of the MEMS device.

Figure 1:
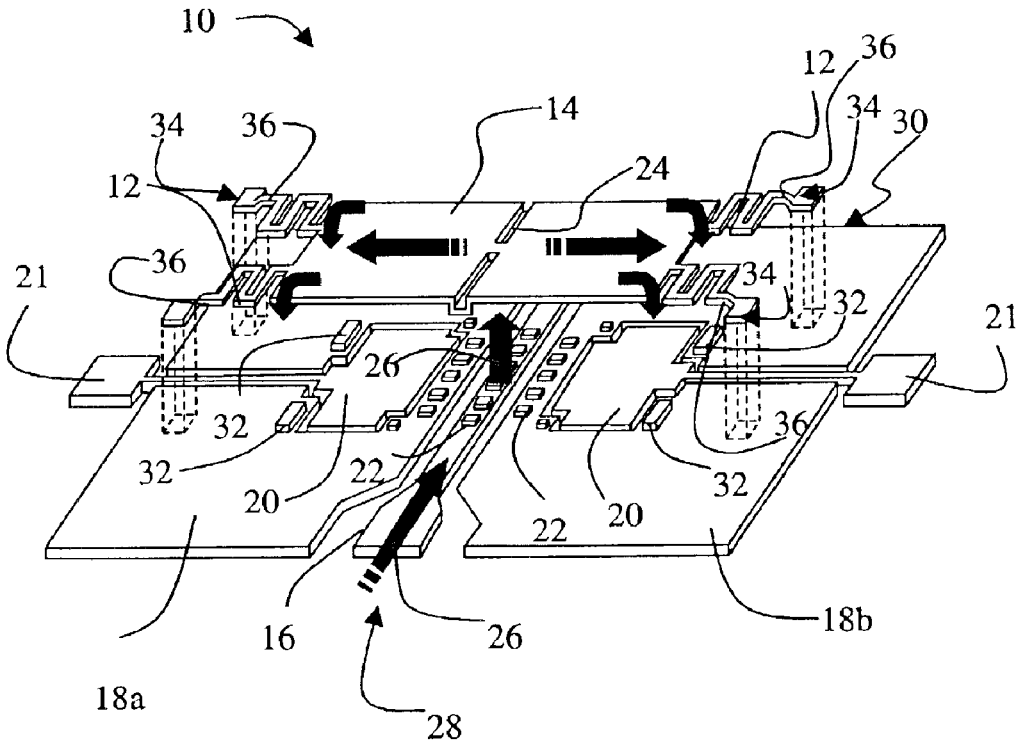
FIG. 1 is a schematic exploded perspective view of a preferred embodiment MEMS shunt switch.

The preferred embodiment of FIG. 1 may be formed on a suitable substrate and is a balanced RF MEMS shunt switch 10, including symmetrically disposed deflection beams 12, which are preferably serpentine in shape, supporting a movable switch pad 14 above a signal line 16 and ground, realized in FIG. 1 by ground pads 18*a* and 18*b*. The switch 10 may form part of a large-scale integration, where the signal line 16 is part of a circuit interconnect pattern, for example. In a relaxed state, the switch pad 14 permits signals to flow through the signal line 16. Application of a suitable voltage to actuation pads 20 through electrodes 21 creates an electrostatic force that pulls the switch pad in to make ohmic contact with both the signal line 16 and the ground 18*a*, 18*b* through preferred contact bumps 22 disposed on the signal line 16 and the ground 18*a*, 18*b*. Electrode 21 would be omitted in an integration where a lead to an actuation pad 20 is part of a circuit interconnect. The switch pad 14 may also preferably include one or more depressions or dimples 24 to aid the ohmic contact with bumps 22 of either or both of the signal line 16 and ground. Arrows 26 indicate primary paths of current flow when the signal line 16 is grounded.

The overall geometry of the switch 10 is advantageous for integration and provides a symmetry aiding efficient operation of the switch. The two ground pads 18*a* and 18*b* are disposed on opposite sides of the signal line 16. Actuation pads 20 are also disposed on opposite sides of the signal line, and are encompassed by the ground pads 18*a* and 18*b*, but electrically separate from the ground pads 18*a* and 18*b*. A symmetry is provided by this arrangement to exhibit an even attraction force on the switch pad 14, which is supported by the deflection beams 12, which are also preferably symmetrically disposed around the switch pad 14.

Current flows in from an input side 28 of the switch 10 into the signal line 16. In a relaxed position of the switch with the switch pad 14 away from the signal line 16, the current is allowed to pass through the signal line 16 to an opposite output side 30 of the switch. In an activated position, the switch pad is pulled into ohmic contact with bumps 22 on the signal line 16 and ground. The bumps 22 are preferably used to prevent the switch pad 14 from touching the actuation pads 20, which may include a nitride or other dielectric layer, or may be exposed conductive material by virtue of the bumps 22 that prevent touching of the switch pad 14 to the actuation pad 20. There is a trade-off between the size of the bumps 22 and the area of the actuation pads that can be modified and optimized to suit particular switches according to the FIG. 1 embodiment. Forming bumps 22 that have larger surface area will reduce the actuation area of the actuation pads 20. The bumps 22 on the ground pads 18*a*, 18*b* may be conductive to provide part of the path to ground, while those on signal line 16 must be conductive. In addition, the switch pad 14 contacts ground posts 32. The ground posts 32 establish a primary path from the input side 28 of the switch to the ground 18. The ground posts 32 create a path from the input side 28 to ground that is lower resistance than the path to ground through the deflection beams 12. In this regard, it is preferable to shape the ground posts 32 to maximize the surface area of the ground posts that will make ohmic contact to the switch pad 14. The trade-off is again a competition with the surface area of the acutation pads 20. Overall cross-section of the posts 32 also should be generous, to the extent permitted by the configuration of a particular switch. The material used for the ground posts 32 and other conductive elements of the switch is preferably any conducting metal, e.g., Ti, Au, Cu, Ni, Pt, but other conductive materials, e.g., poly-silicon, tungsten-silicide, may also be used. Typically, a common metal will be used for the switch pad 14, deflection beams 12 and ground posts 32. Because the deflection beams 12 are conductive and connected to ground, there will be some current flow to ground through the deflection beams 12. A preferred goal in implementing the current bypass aspect of the invention is to minimize the current flow through the deflection beams 12 by maximizing current flow to ground through the ground posts 32 (and bumps 22). Factors affecting the bypass effect of the ground posts 32 will include all material and physical properties that determine the resistance of the respective paths to ground through the deflection beams 12 and the ground posts 32.

Exemplary embodiment ground posts each present a contact area (for contact with the switch pad) of at least 100 $\mu m^2$. This is a minimum area to direct the majority of current passing to the ground in an exemplary prototype embodiment switch according to FIG. 1 where the switch pad and deflection beams are approximately 1 $\mu m$ thick and the deflection beams have a cross-sectional area of approximately 4 to 6 $\mu m^2$. In the exemplary embodiment, the contact area of the ground posts is selected to direct a majority of the current to ground through the ground posts. The minimum surface area required to direct a majority of the current through the ground posts will depend primarily upon the contact area of the ground posts, the resistivity of the material of the ground posts (if it is different than the material of the switch pad/deflection beams), and the cross section of the deflection beams.

The common material of the switch pad 14 and deflection beams 12 is a result of a single deposition used to form these elements. The deflection beams 12 are a shaped extension of the switch pad having the same thinness of the switch pad, typically 0.5 $\mu m$ to 5 $\mu m$. The deflection beams 12 extend to anchor portions 34 that bond to the ground pads 18*a*, 18*b*. In the FIG. 1 embodiment, this is achieved by turns 36 (best seen in FIG. 2C) in the anchor portions 34 of the deflection beams 12. The turns 36 permit the remaining portions of the deflection beams 12 and the switch pad 14 to maintain a relaxed state in a plane away from the ground 18*a*, 18*b* and signal line 16.

Figure 2A:
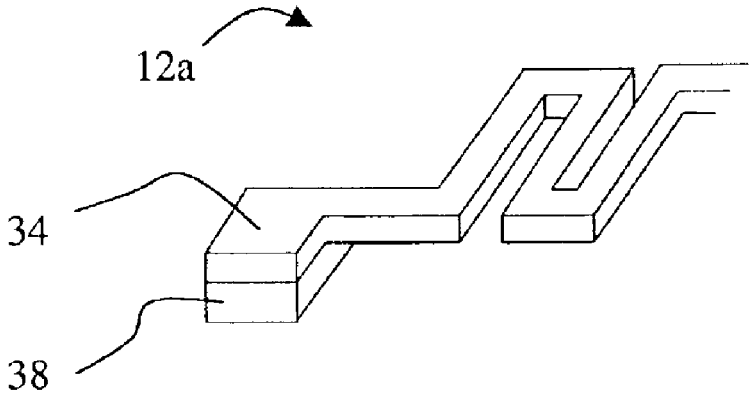
FIG. 2A is a schematic partial view showing a preferred deflection beam for a MEMS device of the invention.
Figure 2B:
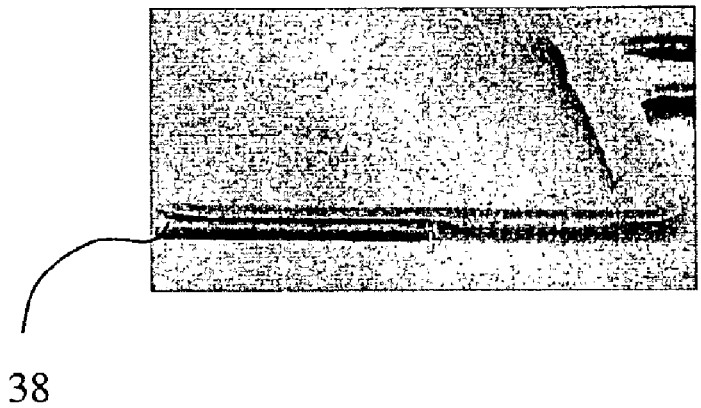
FIG. 2B is an SEM image of the cantilever portion of a prototype device of the invention constructed according to FIG. 2A.

The bypass of ground current flow in the FIG. 1 embodiment through the ground posts 32 extends hot switching lifetime compared to an identical device lacking the ground posts. FIG. 2A shows a further preferred embodiment having a generally flat deflection beam 12*a* including an anchor portion 34 that is generally coplanar with the remaining portions of the deflection beam 12*a*. This is a variation of the FIG. 1 embodiment. An anchor post 38 is formed on the ground pad 18*a*, 18*b* to support each of the anchor portions 34. The anchor post 38 can completely eliminate the need for the turns 36 in the anchor portion 34 of the FIG. 1 embodiment and permit a generally flat, coplanar deflection beams 12*a*. The flat, coplanar embodiment is preferred. Alternatively, the amount or severity of the turn can be reduced by use of the anchor posts 38. The coplanar embodiment illustrated in FIG. 2A is the most structurally sound. An SEM image of a prototype deflection beam portion with anchor posts is shown in FIG. 2B.

Figure 2C:
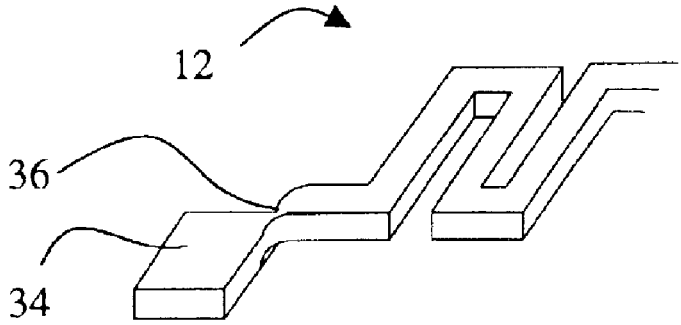
FIG. 2C is a schematic partial view showing an alternate deflection beam used in FIG. 1.

An additional advantage of the anchor posts 38 is a reduction of the gap between the switch pad 14 and the signal line 16. Referring to FIG. 2C, the deflection beams with a turn limit the minimum gap because the turn 36 requires a minimum vertical distance. The FIG. 2A design not only strengthens the deflection beam but also reduces the gap between the switch pad 14 and signal line 16. For low voltage applications, a typical gap for a deflection beam without an anchor post is 4 to 5 mm and the gap lessened to about 2 to 3 mm with use of the anchor posts. Gap reduction lowers the actuation voltage of the switch.

When the anchor posts 38 are used in combination with the ground posts 32, the anchor posts may be made or coated with dielectric material. Any material that forms a suitable bond with the ground pads 18*a*, 18*b* and the anchor portions 34 of the deflection beams may be used. In this preferred embodiment, the resistance of the path to ground through the deflection beams 12 becomes very high compared to the path presented by the ground posts. This may be especially useful in applications where geometry or integration limits the size of ground posts.

Figure 3:
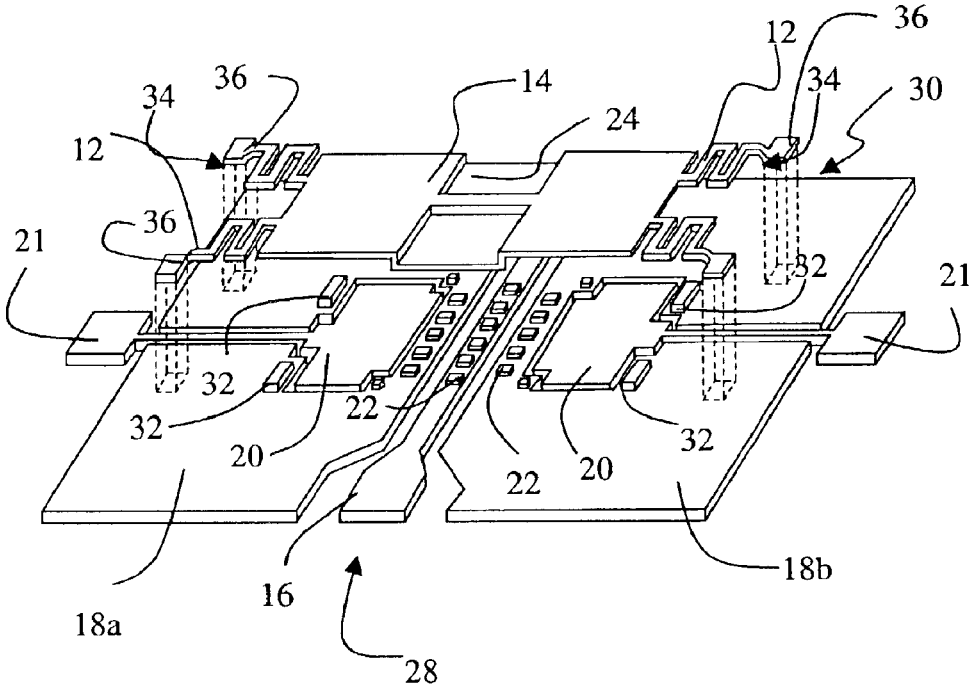
FIG. 3 is a schematic exploded perspective view of a preferred embodiment MEMS shunt switch.
Figure 4:
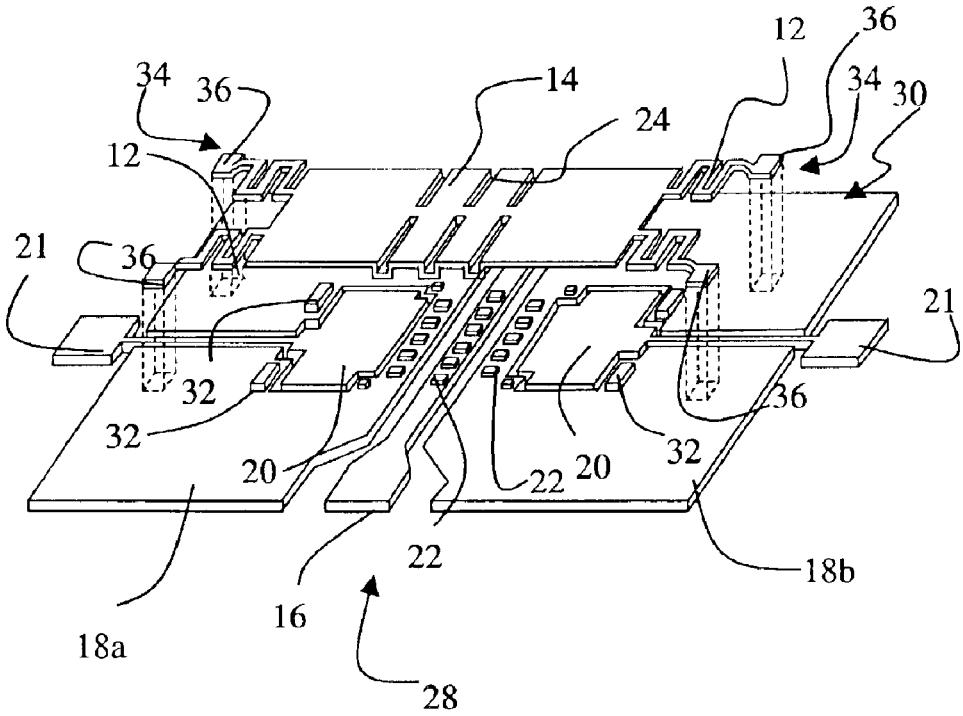
FIG. 4 is a schematic exploded perspective view of a preferred embodiment MEMS shunt switch.

Modifications of switch shapes may include optimizations that decrease resistance of the bypass path to ground of the invention. Examples of modified embodiments having more complexly shaped dimples are shown in FIGS. 3 and 4. The FIGS. 3 and 4 embodiments enhance contact to the bumps 22 that are present on ground pads 18*a*, 18*b* and the signal line 16.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. An MEMS shunt switch, comprising:

a signal line;

a conductive switch pad held opposite said signal line by a deflection beam;

a conductive actuation pad opposing said conductive switch pad;

a ground pad;

a conductive ground post disposed on said ground pad to make ohmic contact with said conductive switch pad when said conductive switch pad makes ohmic contact with said signal line, and wherein said ground post defines a path to ground that has a lower resistance than a path to ground through said deflection beam.

2. The switch of claim 1, wherein said deflection beam comprises a plurality of deflection beams symmetrically arranged to support said conductive switch pad and a plurality of conductive ground posts are disposed on said ground pad to make ohmic contact with said conductive switch pad when said conductive switch pad makes ohmic contact with said signal line.

3. The switch of claim 2, wherein:

said ground pad comprises at least two ground pads disposed on opposite sides of said signal line;

said actuation pad comprises at least two actuation pads generally encompassed within but electrically separate from said two ground pads; and said plurality of said conductive ground posts are disposed on said at least two ground pads around said at least two actuation pads.

4. The switch of claim 1, wherein said ground posts are disposed around at least two sides of said actuation pad.

5. The switch of claim 1, wherein said conductive switch pad includes a dimpled portion aligned over said signal line.

6. The switch of claim 5, further comprising a raised contact bump on said signal line.

7. The switch of claim 1, further comprising an anchor post disposed on said ground pad and wherein said deflection beam is anchored to said anchor post.

8. The switch of claim 7, wherein said deflection beam is generally flat.

9. The switch of claim 7, wherein said anchor post comprises a conductive material.

10. The switch of claim 7, wherein said anchor post comprises a dielectric material.

11. The switch of claim 10, wherein said deflection beams have a serpentine shape.

12. A MEMS shunt switch comprising:

a signal line;

a ground pad;

a conductive actuation pad that is configured to be coplanar with and isolated from said ground pad;

an anchor post disposed on said ground pad, wherein said anchor post comprises a dielectric material; and a conductive switch pad held opposite said signal line by a deflection beam anchored to said post.

13. An MEMS shunt switch, comprising:

a switch pad suspended by a deflection beam opposite a ground and a signal line;

actuation means to pull said switch pad into ohmic contact with said ground line and said signal line; and a current path to said ground through said switch pad from said signal line that bypasses the deflection beam used to suspend said switch pad.

14. The switch of claim 13, wherein said current path to said ground is a lower resistance current path to ground than a current path to ground through said deflection beam.

15. The switch of claim 13, wherein said ground is a ground pad and said deflection beam anchors to an anchor post disposed on said ground pad.

16. An MEMS shunt switch comprising:

a switch pad movable between a first position and a second position relative to a signal line, said second position completing a path from said signal line to ground;

a ground pad;

an actuation pad disposed within a plane of said ground pad and physically and electrically isolated from said ground pad; and a ground post extending from said ground pad toward said switch pad and being disposed within said path and connected to ground and configured to engage said switch pad to prevent contact between said switch pad and said actuation pad.

17. An MEMS shunt switch, comprising:

a flat and coplanar switch pad and deflection beam, anchored to an anchor post disposed upon a ground pad having an acutation pad disposed therein and coplanar therewith, said ground pad being disposed opposite said deflection beam, wherein said coplanar switch pad is movable to make ohmic contact with a signal line and said ground pad.

* * * * *